US009995441B2

(12) United States Patent
Power et al.

(10) Patent No.: US 9,995,441 B2
(45) Date of Patent: Jun. 12, 2018

(54) LED LAMP WITH INTERNAL REFLECTOR

(71) Applicant: Cree, Inc., Durham, NC (US)

(72) Inventors: David Power, Morrisville, NC (US); Nishant Tiwari, Morrisville, NC (US); Mark Corbin Lackey, Raleigh, NC (US)

(73) Assignee: Cree, Inc., Durham, NC (US)

( * ) Notice: Subject to any disclaimer, the term of this patent is extended or adjusted under 35 U.S.C. 154(b) by 115 days.

(21) Appl. No.: 15/017,948

(22) Filed: Feb. 8, 2016

(65) Prior Publication Data

US 2017/0227177 A1 Aug. 10, 2017

(51) Int. Cl.

| | |
|---|---|
| ***F21V 1/00*** | (2006.01) |
| ***F21V 11/00*** | (2015.01) |
| ***F21K 9/68*** | (2016.01) |
| ***F21K 9/232*** | (2016.01) |
| ***F21K 9/66*** | (2016.01) |
| ***F21V 29/70*** | (2015.01) |
| ***F21V 7/04*** | (2006.01) |
| *F21Y 115/10* | (2016.01) |

(52) U.S. Cl.

CPC ..... *F21K 9/68* (2016.08); *F21K 9/232* (2016.08); *F21K 9/66* (2016.08); *F21V 7/04* (2013.01); *F21V 29/70* (2015.01); *F21Y 2115/10* (2016.08)

(58) Field of Classification Search

CPC ... F21K 9/68; F21K 9/66; F21K 9/232; F21V 7/04; F21V 29/70; F21Y 2115/10

USPC ..... 362/235, 236, 247, 249.02

See application file for complete search history.

(56) References Cited

U.S. PATENT DOCUMENTS

| | | | | |
|---|---|---|---|---|
| 6,183,100 | B1 * | 2/2001 | Suckow | B60Q 1/2611 257/E25.028 |
| 6,364,506 | B1 * | 4/2002 | Gallo | F21V 13/04 362/236 |
| 6,846,101 | B2 | 1/2005 | Coushaine | |
| 7,213,940 | B1 | 5/2007 | Van De Ven et al. | |
| 7,347,586 | B2 | 3/2008 | Izardel | |

(Continued)

FOREIGN PATENT DOCUMENTS

| | | | |
|---|---|---|---|
| CN | 203940359 | U | 11/2014 |
| WO | 2015/012635 | A1 | 1/2015 |
| WO | 2015/135327 | A1 | 9/2015 |

OTHER PUBLICATIONS

Energy Star Program Requirements for Lamps—Eligibility Criteria Version 2.0, Mar. 24, 2016.

*Primary Examiner* — Anh Mai
*Assistant Examiner* — Glenn Zimmerman
(74) *Attorney, Agent, or Firm* — Dennis J. Williamson; Moore & Van Allen PLLC

(57) ABSTRACT

In a LED lamp having an optically transmissive enclosure and a base connected to the enclosure a plurality of LEDs are operable to emit light when energized through an electrical path from the base. A reflector has an enclosed wall shape and is disposed such that LEDs are mounted inside of and outside of the reflector. The reflector includes a reflective outer surface where in cross-section the reflective outer surface is disposed at an angle relative to the longitudinal axis of the lamp such that the reflective outer surface diverges away from the longitudinal axis as it extends away from the base. The reflective outer surface may be disposed at an angle of between approximately 83 and 89 degrees relative to the plane of the LEDs.

21 Claims, 7 Drawing Sheets

(56) References Cited

U.S. PATENT DOCUMENTS

| | | | |
|---|---|---|---|
| 8,476,836 | B2 | 7/2013 | van de Ven et al. |
| 8,573,806 | B1 | 11/2013 | Moon |
| 8,672,512 | B2 | 3/2014 | Zhou et al. |
| 8,696,156 | B2 | 4/2014 | Yuan et al. |
| 8,736,186 | B2 | 5/2014 | Chobot |
| 8,742,671 | B2 | 6/2014 | van de Ven et al. |
| 8,791,641 | B2 | 7/2014 | van de Ven et al. |
| 8,810,144 | B2 | 8/2014 | Hu et al. |
| 8,820,962 | B2 | 9/2014 | Kang |
| 8,823,271 | B2 | 9/2014 | van de Ven et al. |
| 8,829,821 | B2 | 9/2014 | Chobot et al. |
| 8,912,735 | B2 | 12/2014 | Chobot et al. |
| 8,975,827 | B2 | 3/2015 | Chobot et al. |
| 8,992,052 | B2 | 3/2015 | Cai et al. |
| 9,101,021 | B2 | 8/2015 | Lys |
| 9,131,561 | B2 | 9/2015 | Athalye |
| 9,155,165 | B2 | 10/2015 | Chobot |
| 9,155,166 | B2 | 10/2015 | Chobot |
| 2012/0230034 | A1* | 9/2012 | Boomgaarden ..... F21V 3/02 362/294 |
| 2012/0300453 | A1* | 11/2012 | Zhou ..... F21V 29/505 362/235 |
| 2013/0026923 | A1 | 1/2013 | Athalye et al. |
| 2013/0162153 | A1 | 6/2013 | van de Ven et al. |
| 2013/0235582 | A1* | 9/2013 | Breidenassel ..... F21V 7/04 362/241 |
| 2013/0314918 | A1* | 11/2013 | Kang ..... F21V 3/00 362/235 |
| 2014/0001959 | A1 | 1/2014 | Motley et al. |
| 2014/0009936 | A1* | 1/2014 | Hata ..... F21K 9/64 362/235 |
| 2014/0167642 | A1 | 6/2014 | Chobot |
| 2014/0268790 | A1 | 9/2014 | Chobot et al. |
| 2015/0102729 | A1 | 4/2015 | Creasman et al. |
| 2015/0351187 | A1 | 12/2015 | McBryde et al. |
| 2016/0053966 | A1* | 2/2016 | Dassanayake ..... F21V 7/0016 362/296.06 |

* cited by examiner

LED LAMP WITH INTERNAL REFLECTOR

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and/or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A separate heat sink is also often needed to cool the LEDs and/or power supply in order to maintain appropriate operating temperature.

SUMMARY OF THE INVENTION

In some embodiments a LED lamp comprises an optically transmissive enclosure and a base connected to the enclosure defining a longitudinal axis extending from the base to the enclosure. A plurality of LEDs are operable to emit light when energized through an electrical path from the base. A reflector has an enclosed wall shape and is disposed such that at least one first LED of the plurality of LEDs is mounted inside of the reflector and a least one second LED of the plurality of LEDs is mounted outside of the reflector. The reflector comprises a reflective outer surface having a proximal end and a free distal end where the reflective outer surface is disposed at a constant angle relative to the longitudinal axis between the proximal end and the distal end.

The reflector may be a diffuse reflector. The reflector may be made of molded plastic. The reflector may comprise an annular shaped ring. The center of the reflector may be on the longitudinal axis. The at least one first LED may comprise a plurality of first LEDs and the at least one second LED may comprise a plurality of second LEDs. The reflective outer surface in cross-section may be disposed at an angle relative to the longitudinal axis such that the reflective outer surface diverges away from the longitudinal axis as it extends away from the base. The at least one second LED may comprise a plurality of second LEDs arranged in a plane and the reflective outer surface may have a proximal end and a free distal end where the reflective outer surface may be disposed at an angle relative to the plane of the LEDs between the proximal end and the distal end. The at least one second LED may comprise a plurality of second LEDs arranged in a plane and the reflective outer surface may be disposed at an angle of between approximately 83 and 89 degrees relative to the plane. The reflective outer surface may be disposed at an angle of approximately 4 degrees relative to normal from the at least one second LED. The reflective outer surface may be relatively flat between a proximal end and a distal end such that in cross-section the reflective outer surface may be a substantially straight line between the proximal end and the distal end. The distal end of the reflective outer surface may terminate at a free corner such that the reflective outer surface does include any structure that extends away from the reflective outer surface. The reflective outer surface may have a height of approximately 7 mm. The reflective outer surface may have a height of less than approximately 10 mm. The reflective outer surface may have a height in the range of approximately 5 to 15 mm. The reflective outer surface may be disposed at an angle relative to the longitudinal axis of the lamp where the angle is in the range of approximately 1° and 7°. The reflective outer surface may be a smooth curve in a transverse plane. The reflector may be positioned relative to the at least one second LED such that the reflector reflects approximately 10% or less of the total lumen output by the at least one second LED. The reflector may be positioned relative to the at least one second LED such that the reflector does not reflect the peak light emitted by the at least one second LED.

In some embodiments a LED lamp comprises an optically transmissive enclosure and a base connected to the enclosure. A plurality of LEDs are operable to emit light when energized through an electrical path from the base. A reflector has a completely enclosed annular or oval shape where at least one first LED of the plurality of LEDs is mounted inside of the reflector and a plurality of second LEDs are mounted outside of the reflector. The plurality of second LEDs are arranged in a plane and the reflector comprises a reflective outer surface having a proximal end and a free distal end where the reflective outer surface is disposed at an angle relative to the plane of the LEDs between the proximal end and the distal end in a range of between approximately 83 and 89 degrees.

DETAILED DESCRIPTION

Figure 2:
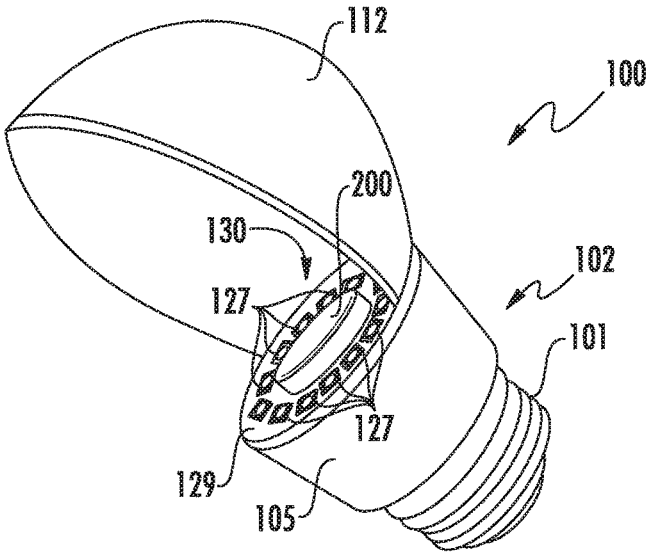
FIG. 2 is a perspective view of the lamp of FIG. 1 with a portion of the enclosure removed.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 1:
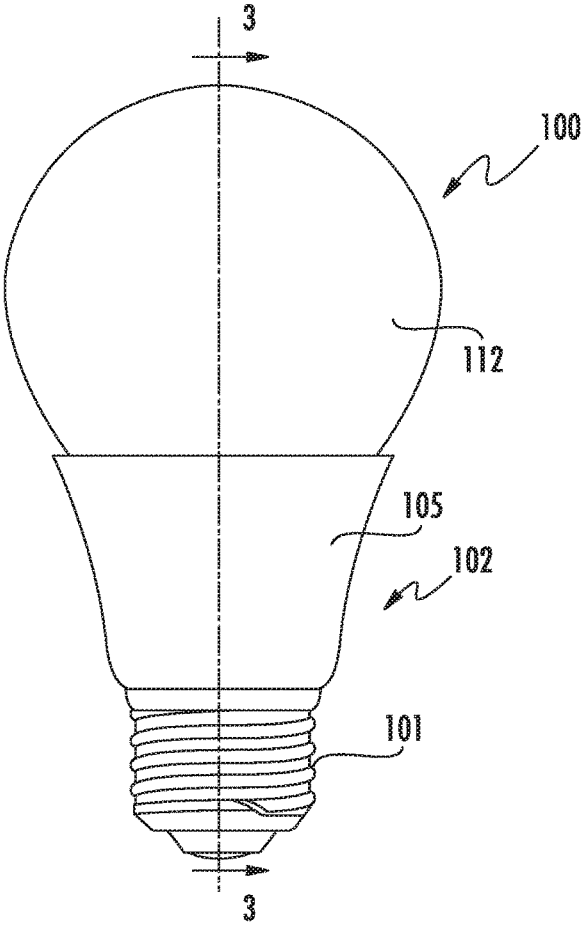
FIG. 1 is a plan view of a lamp in accordance with some embodiments of the invention.
Figure 3:
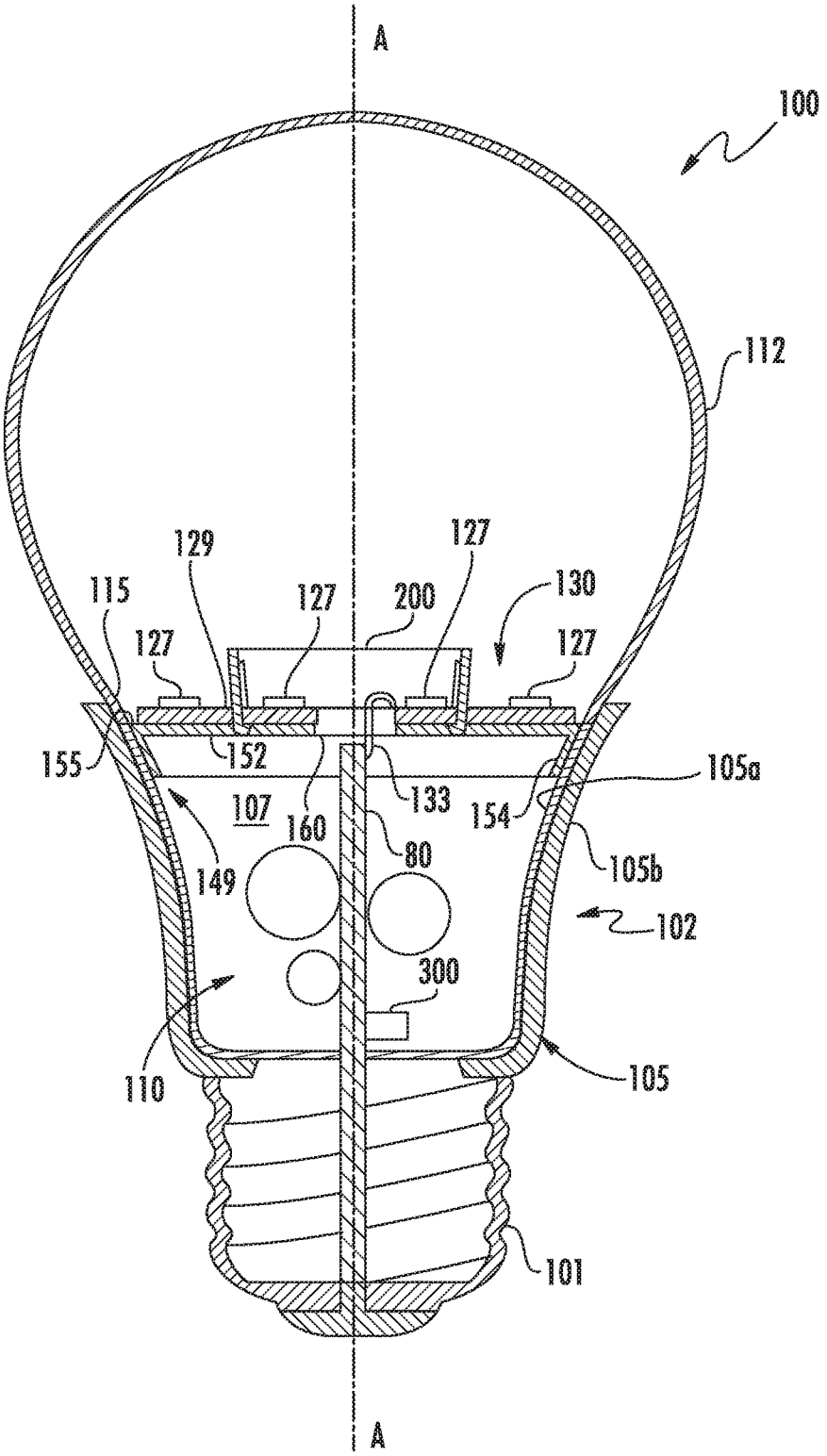
FIG. 3 is a section view taken along line 3-3 of FIG. 1.
Figure 7:
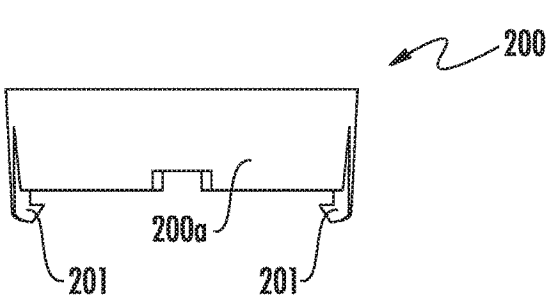
FIG. 7 is a side view of the reflector of FIG. 4.

FIGS. 1 through 3 show an embodiment of a LED lamp 100, according to some embodiments of the present invention, embodied in a form factor of a traditional omnidirectional incandescent bulb. In an omnidirectional lamp, such as lamp 100, the light is emitted in a wide omnidirectional pattern. In one embodiment, the optically transmissive enclosure 112 and base 102 are dimensioned to be a replacement for an ANSI standard A series bulb such that the dimensions of the lamp 100 fall within the ANSI standards for an A series bulb. In one embodiment, the lamp 100 is configured to be a replacement for an ANSI standard A19 bulb such that the dimensions of the lamp 100 fall within the ANSI standards for an A19 bulb. The dimensions may be different for other ANSI standards including, but not limited to, A21 and A23 standards. In the lamp 100, light is emitted from the lamp in an omnidirectional pattern and in one embodiment the lamp may comply with "ENERGY STAR® Program Requirements for Lamps—Eligibility Criteria Version 2.0". It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

One embodiment of a lamp 100 is shown in the figures and comprises a lamp base 102 that may comprise an electrical connector 101, such as an Edison screw, that functions as the electrical connector to connect the lamp 100 to an electrical socket or other power source. Depending on the embodiment, other electrical connector configurations are possible to make the electrical connection such as other standard bases, such as bayonette connectors, two pin connectors or the like, or other non-standard connectors. The base 102 may comprise a housing 105 connected to the electrical connector 101. The electrical connector 101 may be connected to the housing 105 by adhesive, mechanical connector, welding, separate fasteners or the like. The housing 105 may comprise an electrically insulating material such as plastic. Further, the material of the housing 105 may comprise a thermally conductive material such that the housing 105 may form part of the heat sink structure for dissipating heat from the lamp 100. In the illustrated embodiment the housing 105 comprises an inner core 105*a* made of a highly thermally conductive material such as aluminum that conducts heat away from the LED assembly and dissipates the heat and an external shell 105*b* that covers the internal layer 105*a* and forms the external surface of the lamp. The shell 105*b* may be formed of plastic. The core 105*a* and the shell 105*b* have a cup-like configuration that define an internal cavity 107 in the housing 105. The internal core 105*a* and the external shell 105*b* may be formed as a unitary member where the plastic shell is extruded over the metal core or the two layers may be formed separately and joined together to create the base. In other embodiments the highly thermally conductive core 105*a* may be at least partially exposed directly to the exterior of the lamp and may include heat dissipating members such as fins. The housing 105 and the electrical connector 101 define internal cavity 107 for receiving a lamp electronics board 80 such as a PCB board on which the electronics 110 of the lamp including the power supply and/or drivers or a portion of the electronics for the lamp are supported. The board 80 includes electrical connections to the lamp electronics and forms part of the electrical path to the LEDs. The lamp electronics 110 are electrically coupled to the electrical conductor 101 such that an electrical connection may be made from the electrical conductor 101 to the lamp electronics 110. The base 102 may be potted to physically and electrically isolate and protect the lamp electronics 110. The term "electrical path" is used to refer to the electrical path to the LED's 127, and may include an intervening power supply, drivers and/or other lamp electronics, and includes the electrical connection between the electrical connector 101 that provides power to the lamp and the LEDs. The term may also be used to refer to the electrical connection between the power supply and the LEDs and between the electrical connector to the lamp and the power supply. Electrical conductors run between the LEDs 127 and the connector 101 to carry both sides of the supply to provide critical current to the LEDs 127 as will be described.

An at least partially optically transmissive enclosure 112 contains an LED assembly 130 that includes LEDs 127 that emit light when energized through an electrical path from the base 102. The enclosure may be made of glass, plastic, such as polycarbonate, or other optically transmissive material. The enclosure 112 may comprise a diffusive material applied to or formed as part of the enclosure or the enclosure may be made of a clear material. Where glass is used to form the enclosure a shatter proof or shatter resistant coating may be applied to the enclosure. The enclosure 112 may be attached to the base 102. The neck 115 of the enclosure 112 is dimensioned and configured such that the open edge of the enclosure 112 fits inside of or abuts the upper edge of housing 105. To secure these components together a bead of adhesive may be applied between the enclosure 112 and the housing 105. In addition to or in place of the adhesive other connection mechanisms may be used to secure the enclosure to the base such as a snap-fit connection formed by mating deformable fingers and apertures, separate fasteners or the like. In one embodiment, the enclosure 112 and base 102 are dimensioned to be a replacement for omnidirectional bulbs such as ANSI standard A-series bulbs, including but not limited to A19, A21 and A23 bulb, such that the dimensions of the lamp 100 fall within the ANSI standards for such bulbs. The dimensions may be different for other ANSI standards. The structure and assembly method may be used on other lamps and in other embodiments and the LED lamp can have any shape, including standard and non-standard shapes.

The lamp 100 is a solid-state lamp comprising a LED assembly 130 with light emitting LEDs 127. The LED assembly 130 may be implemented using a submount 129 on which the LEDs 127 are mounted. In the present invention the term "submount" is used to refer to the support structure that supports the individual LEDs or LED packages 127 and may comprise a flex circuit, printed circuit board, metal core printed circuit board, lead frame extrusion, or the like or combinations of such structures. The electrical path runs between the submount 129 and the lamp electronics 110 to carry both sides of the supply to provide critical current to the LEDs 127. Multiple LEDs 127 can be used together, forming an LED array. The LEDs 127 can be mounted on or fixed within the lamp in various ways. The LEDs 127 include LEDs which may comprise an LED die disposed in an encapsulant such as silicone, and LEDs which may be encapsulated with a phosphor to provide local wavelength conversion, as will be described later when various options for creating white light are discussed. A wide variety of LEDs and combinations of LEDs may be used in the LED assembly 130 as described herein. The LEDs 127 of the LED assembly 130 are operable to emit light when energized through an electrical connection. In some embodiments the LED assembly 130 is configured with the submount 129 arranged as a generally planar member that extends transversely to the longitudinal axis A-A of the lamp such that the LEDs 127 project light primarily away from the base 102.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. For example in one embodiment the LEDs may all be of the same color where for warm white light blue-shifted yellow LEDs may be used with a yellow, green and/or red phosphor and for a cool white light blue-shifted yellow LEDs may be used with a yellow and/or green phosphor. In some embodiments LEDs that emit soft white light and LEDs that emit cool white light may be used in combination. LED devices can be used with phosphorized coatings packaged locally with the LEDs or with a phosphor coating the LED die as previously described. For example, blue-shifted yellow (BSY) LED devices, which typically include a local phosphor, can be used with a phosphor on or in the optically transmissive enclosure or inner envelope to create substantially white light. In some embodiments, (BSY) LED devices may be combined with, for example, red emitting LED devices in the array to create substantially white light. In other embodiments, the LEDs may be combined where at least one of the LEDs is a blue LED with a yellow or green phosphor and at least one other LED is a blue LED with a red phosphor. These embodiments are provided by way of example and different color light may be produced using a variety of different color LEDs and/or LEDs with various phosphors. Such embodiments can produce light with a CRI of at least 70, at least 80, at least 90, or at least 95. By use of the term substantially white light, one could be referring to a chromacity diagram including a blackbody 160 locus of points, where the point for the source falls within four, six or ten MacAdam ellipses of any point in the blackbody 160 locus of points. In some embodiments a CRI of 90 or higher may be achieved by providing: a light path that includes spectral notching material (e.g. neodymium or other filters coated on or within the enclosure); and/or high CRI light source/components that may include BSY+R LEDs; blue LEDs with yellow, green, and/or red phosphors (the phosphors may be mixed in a single layer within the component, or one or more of the phosphors may be in separate layers within the component); and/or spectral notching material incorporated with the component.

A lighting system using the combination of BSY and red LED devices referred to above to make substantially white light can be referred to as a BSY plus red or "BSY+R" system. In such a system, the LED devices used include LEDs operable to emit light of two or more different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

Electrical conductors 133 run between and are electrically coupled to the LED assembly 130 and the lamp electronics 110 to carry both sides of the supply to provide critical current to the LEDs 127 from electrical connector 101. Base 102 may include the electronics 110 for powering lamp 100 and may include a power supply and/or driver and form all or a portion of the electrical path between the mains and the LEDs. Base 102 may also contain only part of the power supply circuitry while some smaller components reside on the submount on which the LEDs are mounted. In some embodiments, the driver and/or power supply that form a portion of the electrical path to the LEDs 127 are included in the base 102 as shown. In other embodiments the driver and/or power supply are included with the LEDs 127 on the submount 129. The power supply and drivers may also be mounted separately where components of the power supply are mounted in the base 102 and the driver is mounted with the submount 129 in the enclosure 112. In some embodiments any component that goes directly across the AC input line may be in the base 102 and other components that assist in converting the AC to useful DC may be in the enclosure 112. In one example embodiment, the inductors and capacitor that form part of the EMI filter are in the base 102. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations, or a boost supply at lower voltages.

The submount 129 may comprise a series of anodes and cathodes arranged in pairs for connection to the LEDs 127. In the illustrated embodiment twenty pairs of anodes and cathodes are used for an LED assembly having twenty LEDs 127; however, a greater or fewer number of anode/cathode pairs and LEDs may be used. Moreover, the submount 129 may comprise more than one component. Electrical connectors or conductors such as traces connect the anode from one pair to the cathode of the adjacent pair to provide the electrical path between the anode/cathode pairs during operation of the LED assembly 130. An LED or LED package 127 containing at least one LED is secured to each anode and cathode pair where the LED/LED package spans the anode and cathode. The LEDs/LED packages may be attached to the submount by soldering. The electrical conductors such as traces may be covered in an electrically insulating material such that no live electronics are exposed. In one embodiment, the exposed surfaces of the submount 129 may be coated with silver, white plastic or other reflective material to reflect light inside of enclosure 112 during operation of the lamp. The submount 129 may have a variety of shapes, sizes and configurations.

In one embodiment of LED assembly 130 the submount 129 comprises a flex circuit. A flex circuit may comprise a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 127 on the flex circuit and for creating the electrical path between the components. In some embodiments of LED assembly 130, the submount 129 may comprise a metal core board such as a metal core printed circuit board (MCPCB). The metal core board comprises a thermally and electrically conductive core made of aluminum or other similar pliable metal material. The core is covered by a dielectric material such as polyimide. Metal core boards allow traces to be formed therein to create the electrical pads for mounting the electrical components such as LEDs 127 and for creating the electrical path between the components. The submount 129 may also comprise a PCB, flexible PCB or a PCB with FR4. The PCB, flexible PCB or PCB with FR4 may comprise thermal vias, where the thermal vias for dissipating heat to the heat sink 149. A PCB may comprise copper sheets laminated on a non-conductive submount. A PCB FR4 board comprises a thin layer of copper foil laminated to one side, or both sides, of an FR4 glass epoxy panel. Circuitry is etched or otherwise formed in the copper layers to create the electrical pads for mounting the electrical components such as LEDs 127 and for creating the electrical path between the components. In some embodiments the submount 129 may comprise a lead frame structure. In a lead frame structure a thin layer of conductive material such as copper is formed into the circuit pattern to create the electrical pads for mounting the electrical components such as LEDs 127 and for creating the electrical path between the components. In other embodiments of the LED assembly 130 the submount 129 may comprise a hybrid of such structures.

To provide electrical current from the connector 101 to the lamp electronics 110 on the board 80 a soldered, wired connection may be used between the electrical connector 101, such as an Edison screw, and the lamp electronics board 80. In some embodiments, spring contacts may be used on the board 80 such that the electrical connection between the electrical connector 101 and the board 80 may be made without soldering or wires. The spring contacts may be deformed into contact with the conductive terminals of the electrical connector 101 when the lamp electronics board 80 is inserted into the base 102.

Referring to FIG. 3, the LED assembly 130 may be mounted to a heat sink structure 149. The heat sink structure 149 may comprise a platform 152 that supports the LED assembly 130 and that is positioned adjacent the open neck of the enclosure 112 transverse to the longitudinal axis A-A. The platform 152 may comprise a LED assembly mounting surface 155. The mounting surface 155 for the LED assembly is disposed at or near the open neck 115 at the end of the enclosure 112 such that the LEDs 127 are disposed in the enclosure adjacent the point where the enclosure 112 joins the base 102. The mounting surface 155 extends substantially transversely to the longitudinal axis A-A of the lamp (the longitudinal axis being the axis extending from the base 102 toward the distal end of the lamp as represented by line A-A of FIG. 3) such that the LEDs 127 are directed substantially along the longitudinal axis of the lamp away from the base 102 and toward the distal end of the enclosure 112. The platform 152 also comprises an annular flange 154 that extends from the mounting surface 155 to the inner core 105*a* of the housing 105. The flange 154 may be press fit into the housing 105 such that the platform 152 is firmly supported in the base 102 and a thermal path is created between the platform 152 and the base 102. The platform 152 and the heat conducting base 105*a*, 105*b* may together form the heat sink structure of the lamp. The heat sink 149 may be made of any thermally conductive material or combinations of thermally conductive materials.

The LED assembly mounting surface 155 may be formed as a planar member configured to make good thermal contact with the submount of the LED assembly 130 such that heat generated by the LED assembly 130 may be efficiently transferred to the heat sink 149. While the LED assembly 130 and the LED assembly mounting surface 155 are shown as being planar these components may have other configuration provided good thermal conductivity is created between the LED assembly 130 and the heat sink 149. Further, while heat transfer may be most efficiently made by forming the mounting surface 155 and the LED assembly 130 with mating complimentary shapes, the shapes of these components may be different provided that sufficient heat is conducted away from the LED assembly 130 that the operation and/or life expectancy of the LEDs are not adversely affected.

The LED assembly mounting surface 155 may comprise an aperture 160 that communicates the exterior of the heat sink 149 with the interior cavity 107 of the base 102. The aperture 160 may be disposed such that the electrical connectors 133 may electrically couple the board 80 to the LED assembly 130. To provide electrical current from the lamp electronics 110 on the board 80 to the LED assembly 130 the electrical connectors 133 may comprise a soldered, wired connection between electrical contacts 161 on the submount 129 and the lamp electronics board 80. In other embodiments spring contacts on the lamp electronics board 80 may be disposed below and may be accessible through the aperture 160. In some embodiments, spring contacts may be used on the board 80 such that the electrical connection between the submount 129 and the board 80 may be made without soldering or wires. The electrical contacts 161 on submount 129 may be formed as pads that are electrically coupled to the spring contacts on the board. In some embodiments the submount 129 may be formed with an electrical connector portion or tab that extends from the submount 129 and through the aperture 160 where it may electrically couple to spring contacts on the board 80. The electrical connector portion on submount 129 may support two electrical contact pads that are connected to the electronics on the submount 129 and that form part of the electrical path to the LEDs 127. The lamp electronics board 80 may include a first spring contact and a second spring contact that allow the lamp electronics 110 to be electrically coupled to the LED assembly 130 in the lamp using an electric contact coupling. The spring contacts may be secured to and electrically coupled with the circuit board 80 where the first spring contact may be electrically coupled to one of the anode or cathode side of the lamp electronics 110 and the second spring contact may be electrically coupled to the other one of the anode or cathode side of the lamp electronics. The spring contacts create an electrical connection between the anode side and the cathode side of the board 80 and the anode and cathode side of the LED assembly 129. The resilient conductors are deformed when the submount 129 is mounted on the heat sink 149 to create the electrical contact coupling. In some embodiments the spring contacts may be mounted on a separate electrical interconnect that electrically couples the submount 129 to the board 80 where deformable electrical contacts on the electrical interconnect engage contact pads 161 on the submount 129 and similar pads on the board 80. The electrical interconnect may be inserted through aperture 160 and aperture 162 on the submount 129 to complete the connection between the submount 129 and the board 80.

Figure 13:
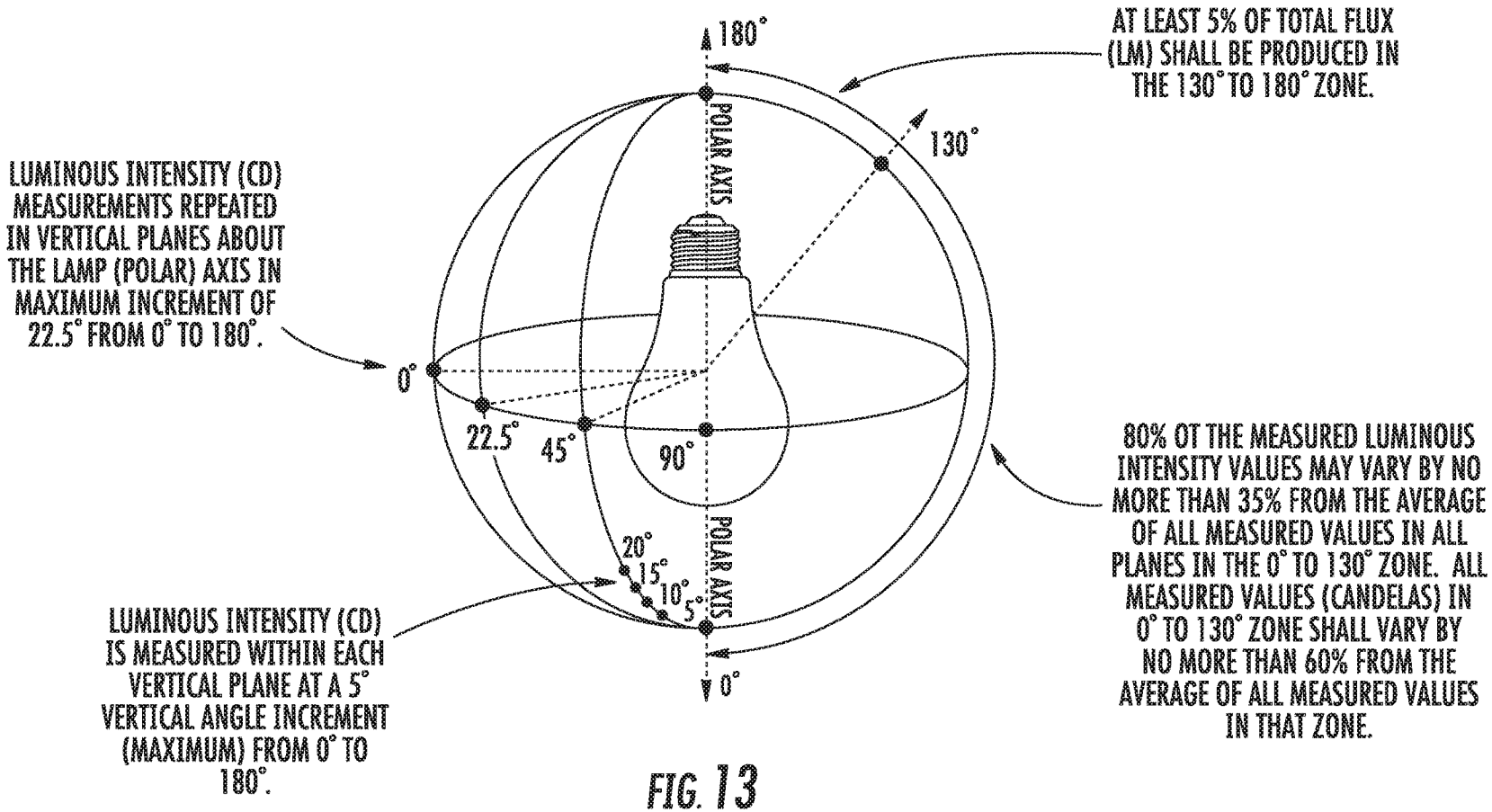
FIG. 13 is a drawing taken from the "ENERGY STAR® Program Requirements for Lamps—Eligibility Criteria Version 2.0" useful in explaining the invention.

While the desired luminous intensity distribution may comprise any luminous intensity distribution, in one embodiment the desired luminous intensity distribution conforms to the ENERGY STAR® Program Requirements for Lamps—Eligibility Criteria Version 2.0, which is incorporated herein by reference. For an omnidirectional lamp the Luminous Intensity Distribution is defined as an even distribution of luminous intensity (candelas) within the 0° to 135° zone (vertically axially symmetrical). Luminous intensity at any angle within this zone shall not differ from the mean luminous intensity for the entire 0° to 135° zone by more than 35%. No less than 5% of total flux (lumens) must be emitted in the 135°-180° zone. Distribution shall be vertically symmetrical. FIG. 13 is a diagram useful in explaining the luminous intensity distribution described above and is taken from the ENERGY STAR® Program as identified above. As shown, the free end of the enclosure 112, opposite to the base, is considered 0° and the base of the lamp is considered 180°. As defined in the standard, luminous intensity is measured from 0° to 180° where the measurements are repeated in vertical planes in maximum increments of 22.5°. The structure and operation of lamp 100 of the invention will be described with specific reference to the ENERGY STAR® standard set forth above; however, the lamp may be used to create other light intensity distribution patterns. In some embodiments, LEDs emit more light perpendicular to the substrate, and have a view angle of approximately 120 degrees FWHM. The reflector described herein creates the required light in the 135°-180° zone such that a lamp as described herein satisfies the ENERGY STAR® Program Requirements for Lamps.

To create an omni-directional light pattern with sufficient light directed toward the base 102 (i.e. downlight) a reflector 200 is provided that reflects a portion of the light generated by the LED assembly 130 generally in a direction toward the base of the lamp. In some embodiments, the reflector 200 may be a diffuse or Lambertian reflector and may be made of a white highly reflective material such as injection molded plastic, white optics, PET, MCPET, or other reflective materials. The reflector 200 may reflect light but also allow some light to pass through it.

Figure 8:
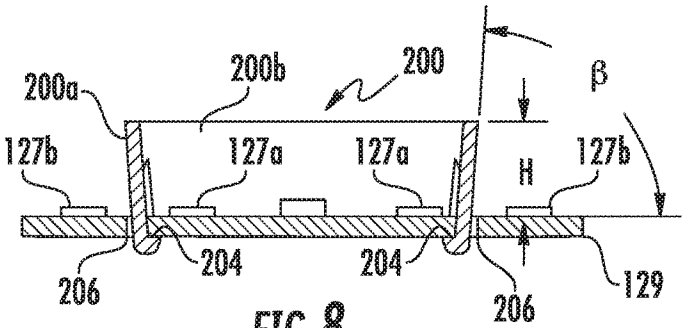
FIG. 8 is a section view taken along line 8-8 of FIG. 6 showing the reflector mounted on a LED board.
Figure 5:
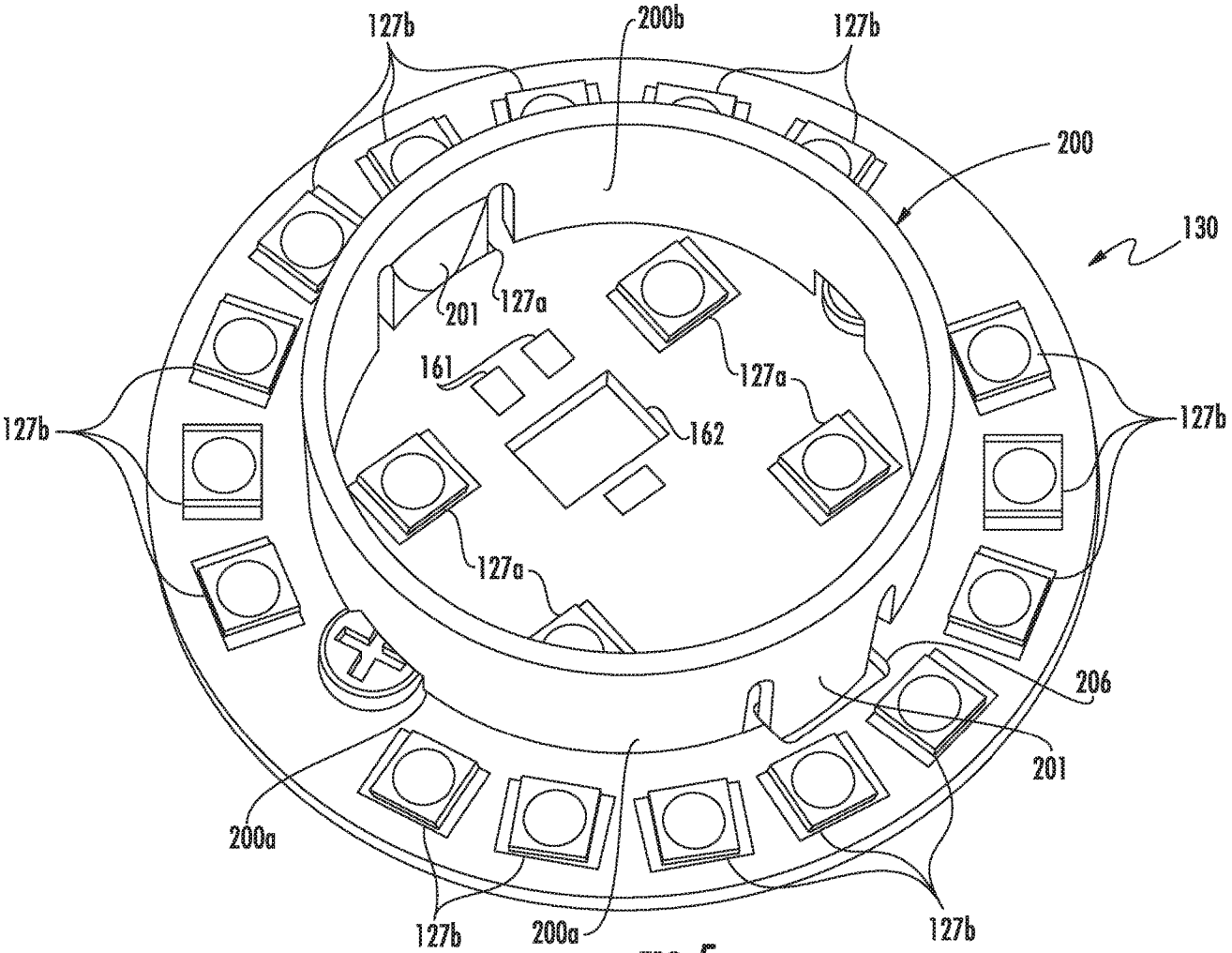
FIG. 5 is a perspective view of the reflector and LED assembly of the lamp of FIG. 1.
Figure 9:
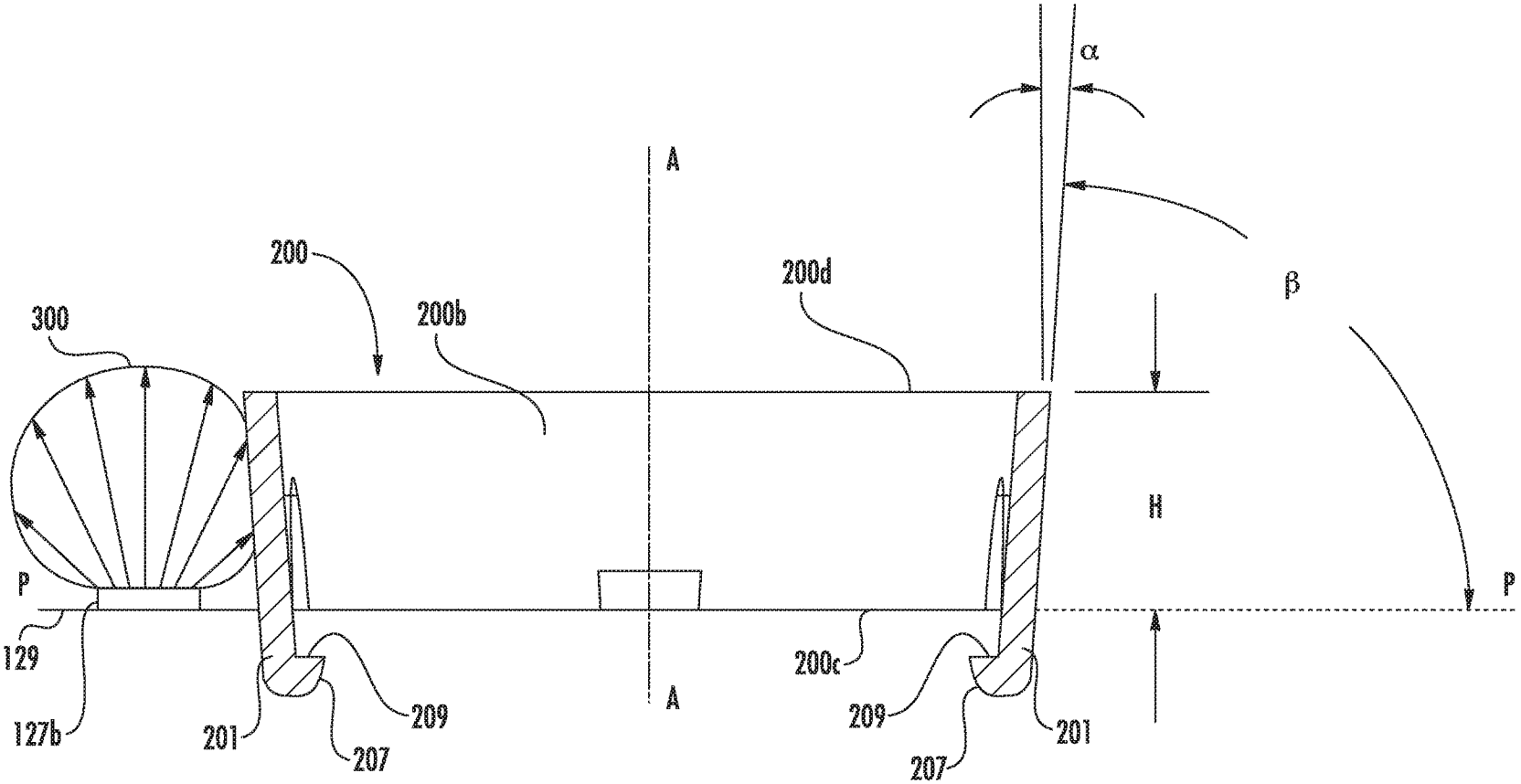
FIG. 9 is a section view similar to FIG. 8 showing details of the reflector.

The reflector 200 may be shaped to produce a directional light pattern of a specific shape. In some embodiments the reflector 200 comprises an enclosed wall that extends generally vertically from the adjacent the LEDs 127. The reflector 200 defines a first area that is internal of and enclosed by the reflector and a second area that is external of the reflector. While in one embodiment the reflector is made of a single piece, the reflector may be made of multiple pieces. The term "enclosed wall" is used herein to mean a structure that extends generally away from the submount along the axis of the lamp where the structure forms an enclosed shape such as, but not limited to, a ring or annulus. Moreover the term "enclosed wall" includes a wall structure such as shown that has small gaps in the wall provided the gaps do create visible shadows or dark spots. A completely enclosed wall may be considered a wall having no gaps. In one embodiment the enclosed wall is a substantially annular shaped ring having a relatively thin walled construction where at least a first plurality of the LEDs are arranged inside of the reflector 200 and a second plurality of LEDs are arranged outside of but adjacent to the reflective outer surface 200*a* of the reflector. The LEDs disposed inside of the reflector may be referred to herein as interior LEDs 127*a* and the LEDs disposed outside of the reflector may be referred to herein as exterior LEDs 127*b* as shown in FIGS. 5 and 8. The reflector 200 is configured such that the reflective outer surface 200*a* of the reflector is angled slightly relative to the longitudinal axis A-A of the lamp such that some of the light emitted by the exterior LEDs 127*b* is reflected toward the base 102 of the lamp by the reflective outer surface 200*a*. Referring to FIG. 9 in cross-section the reflective outer surface 200*a* of the reflector 200 is disposed at an angle $\alpha$ relative to the longitudinal axis A-A of the lamp where the reflective outer surface diverges away from the longitudinal axis as the reflective outer surface extends away from the submount 129 such that some of the light that is reflected from the reflective outer surface 200*a* is reflected toward the base. In other words the included angle $\theta$ between the reflective outer surface 200*a* and the plane of the LEDs 127 P-P is less than 90°. In some embodiments such as the illustrated A series lamp the plane P-P is transverse or perpendicular to the longitudinal axis A-A where the plane P-P and the surface of the submount 129 are parallel. The orientation of the reflective outer surface 200*a* has been described with respect to a cross-sectional view of the lamp taken in a plane perpendicular to the reflective outer surface 200*a* and to the plane P-P. In FIG. 9 the plane is through the longitudinal axis A-A. It will be appreciated that when considered in three-dimensions the reflective outer surface 200*a* is formed as a circle or other closed loop that is surrounded by the exterior LEDs 127*b* where in one embodiment the center of the reflector 200 is the longitudinal axis of the lamp. In some embodiments the reflector may not be a circle or ring such that in plan view the outer wall of the reflector may have an oval or oblong shape or other smooth curved shape. Moreover, the reflector and LEDs may not necessarily be centered on the longitudinal axis of the lamp.

Where the submount is not flat or where some exterior LEDs 127*b* do not lie in the same plane, for example, the angle $\beta$ is the angle defined by the reflective outer surface 200*a* and the plane in which the LEDs lie for those LEDs that are to reflect light from the reflective outer surface. It will be appreciated that in some embodiments such as the embodiment of FIG. 9 angle $\alpha$ and angle $\beta$ are complementary angles.

The angle of the reflective outer surface 200*a* relative to the LEDs 127*b* may also be described with reference to the light profile emitted by the LEDs. A typical LED emits light in a directional pattern, one such pattern is illustrated graphically at 300 in FIG. 9, where the peak intensity is directed perpendicularly away from the LED (parallel to the longitudinal axis A-A in the illustrated lamp). The light intensity typically decreases as the beam angle increases where typical LEDs emit light in a 120° to 140° beam angle. The reflective outer surface 200*a* is arranged such that the reflective outer surface 200*a* does not reflect the peak intensity light emitted by the LEDs 127*b*. The reflective outer surface 200*a* reflects only lower intensity light due to its shallow angle relative to perpendicular where the reflective outer surface 200*a* is disposed at an angle α of between approximately 1 and 7 degrees over its entire length and in one embodiment is approximately 4 degrees over its entire length. The reflector 200 may be positioned relative to the exterior LEDs 127*b* such that the reflective outer surface 200*a* reflects approximately 10% or less of the total lumen output by the exterior LEDs. Moreover, the reflector may be positioned relative to the exterior LEDs 127*b* such that the reflective outer surface 200*a* does not reflect the peak light emitted by the LEDs 127*b*. The reflector 200 accomplishes this by comprising a relatively small reflective outer surface 200*a* that is disposed at a shallow angle relative to the direction of the peak light output of the LEDs such that a small fraction of the light emitted by the LEDs contacts and is reflected by the reflective outer surface 200*a*. Moreover, because the reflector does not have structure that is disposed transverse to the LEDs or that extends over or across the LEDs the amount of light that contacts the reflector is relatively small. In some embodiments, the reflective outer surface 200*a* does not include a component or structure that extends transverse to the LEDs that would reflect light having peak intensity.

While the reflective outer surface 200*a* is angled relative to the longitudinal axis of the lamp the reflective outer surface 200*a* is relatively flat between the proximal end 200*c* and the distal end 200*d* such that in cross-section the reflective outer surface 200*a* is a straight line between the proximal end 200*c* and the distal end 200*d*. While the reflective outer surface 200*a* is described herein as flat it is to be understood that flat as used herein means substantially flat considering manufacturing tolerances and other physical limitations. Moreover, the reflective outer surface 200*a* may have a slight curvature between the proximal end 200*c* and the distal end 200*d* provided that the curvature does not create an overhang or lip at the distal end 200*d* and provided that the reflective outer surface 200*a* does not reflect a significant portion of the light emitted by the LEDs 127*b* as previously explained. One way to consider this is that any radius of curvature of the reflective outer surface 200*a* is large relative to the height H of the wall. Another way to consider the arrangement of the outer reflective outer surface is that a tangent to the outer reflective outer surface does not extend at an angle α of greater than 7 degrees at any point along the outer reflective outer surface.

The distal end of the reflective outer surface 200*a* terminates at a free corner such that the reflective outer surface 200*a* does not include any structure that extends away from the outer wall over the LEDs. As such the reflector does not include a transverse component such as a lip or flange that extends in a cantilevered manner horizontally outwardly from the distal end 200*d* of the reflective outer surface 200*a*.

In a lamp that has a form factor similar to an incandescent A series bulb as shown in the figures in one embodiment the reflective outer surface 200*a* has a height H of approximately 7 mm, in other embodiments the reflective outer surface 200*a* has a height less than approximately 10 mm and in some embodiments the reflective outer surface 200*a* has a height of in the range of approximately 5 to 15 mm. As shown in the drawings the height H is the distance along the longitudinal axis A-A of the lamp between the plane pf the LEDs 127 (which in some embodiments corresponds approximately to the top of the submount 129) and the distal end 200*d* of the reflective outer surface 200*a*.

In a lamp that has a form factor similar to an incandescent A series bulb in one embodiment the angle β is less than 90° and is approximately 86° and in other embodiments the angle β is in the range of approximately 83° and 89°. The angle β is no smaller than 83° at any point along the outer reflective outer surface between the proximal end 200*b* and the distal end 200*c*. Likewise the angle α that the reflective outer surface is angled from parallel to axis A-A is approximately 4° and in other embodiments the angle α is in the range of approximately 1° and 7°. The angle α is no greater than 7° at any point along the outer reflective outer surface between the proximal end 200*b* and the distal end 200*c*. The angle of the outer reflective outer surface may be constant from the proximal end to the distal end. A circular reflector as shown may have a diameter of approximately 25 mm and may be in the range of approximately 20 mm-30 mm.

As is evident from the foregoing description the reflector is relatively small and the reflective outer surface 200*a* is disposed nearly parallel to the longitudinal axis A-A of the lamp such that the reflective outer surface 200*a* reflects only a small portion of the light emitted by the LEDs. Because the reflective outer surface 200*a* has a very small transverse component (perpendicular to axis A-A) with no transverse lip or flange the reflector does not create visible shadows on the enclosure and minimally affects the efficiency of the lamp. While the angle of reflective outer surface is small and the height of the reflective outer surface is small, the reflector provides a light pattern that meets the Energy Star® requirements described herein.

The inner surface of the lamp 200*b* is shown as being disposed at the same angle as the reflective outer surface 200*a* such that the wall of the reflector 200 has a uniform thickness from the proximal end 200*c* to the distal end 200*d*. However, the inner surface 200*b* and the reflective outer surface 200*a* need not be parallel such that the inner surface 200*b* may be at a different angle relative to the axis A-A or it may be parallel to the axis A-A. Because LEDs 127*a* are located inside of the reflector 200 the inner surface 200*b* may also be used to reflect some of the light generated by the internal LEDs 127*a* to create a desired light pattern. The angle of the inner surface 200*b* may be selected to obtain a desired light pattern.

Figure 4:
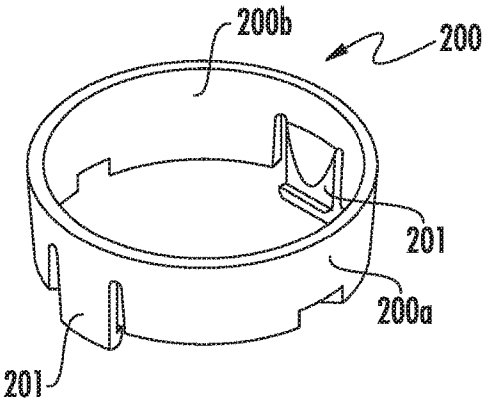
FIG. 4 is a perspective view of the reflector used in the lamp of FIG. 1.
Figure 6:
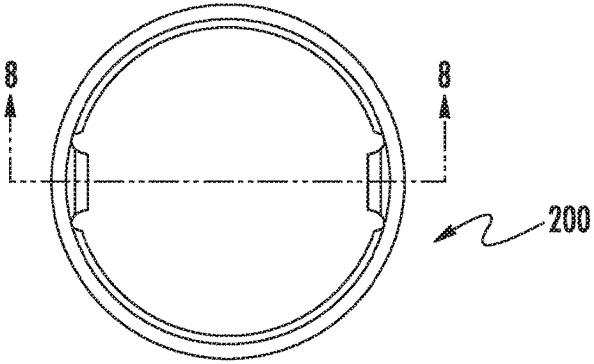
FIG. 6 is a top view of the reflector of FIG. 4.

In one embodiment the reflective outer surface 200*a* is a smooth curve in the transverse plane as shown in FIGS. 4-6. In particular the reflective outer surface 200*a* is shown as a circle. Use of a smooth curved surface provides an even and symmetric reflected light pattern such that the reflective outer surface 200*a* reflects the light without creating any shadows or dark or bright spots that may be visible to the eye. While a smooth curved reflective outer surface 200*a* may be preferred the reflective outer surface 200*a* may be made of a plurality of segments that curvature of the approaches a smooth surface. For example the reflective outer surface 200*a* may be made of a large number of planar surfaces arranged to form the curved reflective outer surface 200*a* where the number of planar surfaces is large enough that the reflective outer surface 200*a* may function in the same manner and be considered a smooth curved wall for all practical purposes. The specific shape of the reflector 200 as described herein is particularly advantageous for relatively higher powered lamps such as lamps equivalent to 60 Watt bulbs or greater, for example, 60 Watt, 75 Watt and 100 Watt equivalent lamps.

Figure 11:
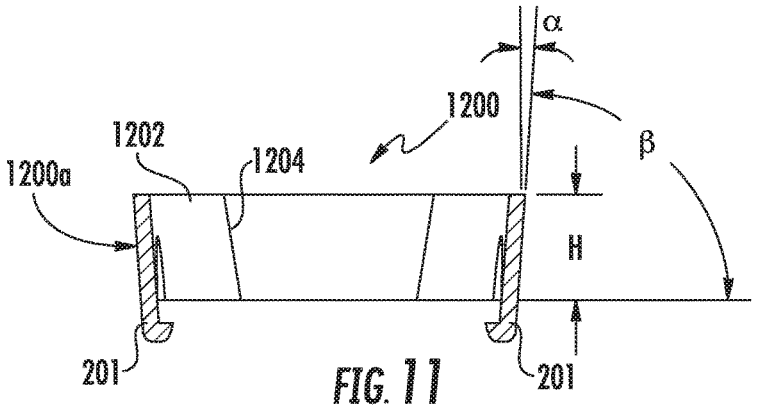
FIG. 11 is a section view of the reflector taken along line 11-11 of FIG. 10.
Figure 10:
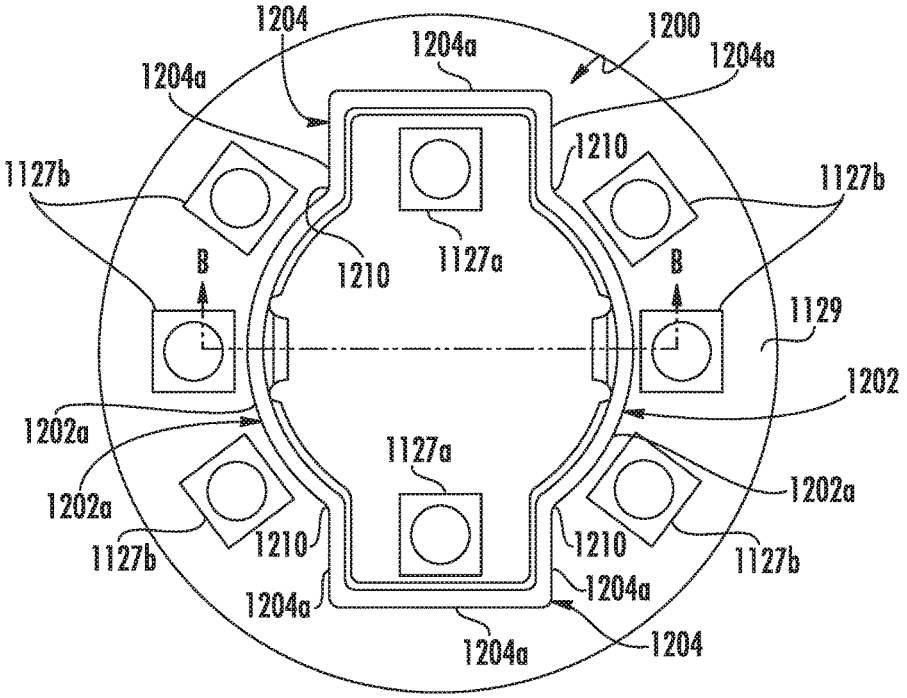
FIG. 10 is a top view of an alternate embodiment of the reflector of the invention mounted on a LED board.
Figure 12:
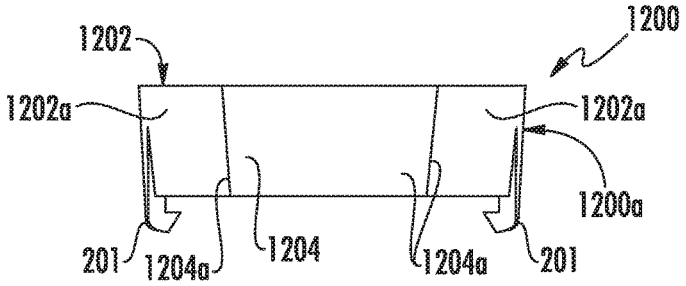
FIG. 12 is a side view of the reflector of FIG. 10.

An alternate embodiment of the reflector 1200 is shown in FIGS. 10, 11 and 12 where the reflective outer surface 1200*a* has an irregular shape rather than the smooth curved circular surface shown in FIGS. 1-9. The irregular shape is used in embodiments where the more regular shape of an uninterrupted circle, oval or the like such as described above may not be advantageously used. The irregular shape of FIGS. 10-12 may be advantageously used in smaller lamps where fewer LEDs 1127*a*, 1127*b* are used on a smaller submount 1129 such that a circular or oval reflector cannot accommodate at least one interior LED and at least one exterior LED. For example the LED assembly of FIGS. 10-12 may be used for an A series lamp having relatively lower lumen output such as a 40 Watt equivalent lamp. To provide the lower lumen output fewer LEDs are used that are spaced on a smaller submount 1149 such that a simple circular or oval reflector may not be fit into the LED assembly. Because of the tight placement of the LEDs and the relatively small area of the submount 1149 it may be difficult to position a circular or oval reflector such that at least one LED is positioned inside of the reflector and at least one LED is positioned outside of the reflector. In order to fit the reflector 1200 in the LED assembly, the reflector 1200 comprises a generally circular or oval center section 1202 having a projecting end section or wing 1204 extending from either end of the center section 1202. The wings 1204 are arranged such that the at least one interior LED 1127*a* is positioned inside of each of the wings 1204 while the remaining exterior LEDs 1127*b* are positioned adjacent and surrounding the center section 1202. The center section reflective outer surface 1202*a* is angled as previously described with respect to the embodiments of FIGS. 1-9. The outer reflective outer surfaces 1204*a* of the two wings 1204 may also be angled in the same manner. While the wings 1204 are shown as rectangular areas the wings may also be circular or oval in shape. The arrangement shown in FIGS. 10-12 provides interior LEDs 1127*a* that project most of the emitted light toward the distal end of the enclosure and provides exterior LEDs 1127*b* that project at least a portion of the light that is reflected by the reflective outer surfaces 1202*a*, 1204*a* toward the base of the lamp. As shown in the figures the transitions 1210 between the center section 1202 and the end sections 1204 may be curved to prevent sharp corners that may be visible as shadows on the lamp. As shown in the figures the exterior LEDs 1127*b* are arranged in the same relationship to the angled outer reflective outer surfaces as the exterior LEDs 127*b* in the embodiment of FIGS. 1-9 such that the light from the exterior LEDs 1127*b* is reflected in the same manner.

The reflector 200, 1200 may be mounted in the lamp in a variety of manners using a variety of connection mechanisms. In one embodiment the reflector is mounted to the submount using a snap-fit connector. Referring to FIGS. 8 and 9, first engagement members on the reflector 200 may engage mating second engagement members on the submount 129 to connect the reflector to the submount using a snap-fit connection. In one embodiment, the first engagement members comprise deformable resilient fingers 201 that comprise a camming surface 207 and a lock surface 209. The second engagement member comprises a fixed members 204 in the form of the edges of openings 206 formed in submount 129. In the illustrated embodiment two fingers 201 are provided although a greater or fewer number of fingers may be provided. The fingers 201 may be made as one-piece with the reflector 200. For example, the reflector 200 and fingers 201 may be molded of plastic. The reflector 200 may be moved toward the submount 129 such that the fingers 201 are inserted into the openings 206. The camming surface 207 of each finger 201 contacts the edge of the mating opening 206. The engagement of the camming surface 207 with the edge of opening 206 deforms the finger 201 to allow the locking member 209 to move past the edge of the opening. As the lock member 209 passes the edge of the opening the finger 201 returns toward its undeformed state such that the lock member 209 is disposed behind the submount 149. The engagement of the lock members 209 with the submount 149 fixes the reflector 200, 1200 to the submount. The snap-fit connection allows the reflector 200 to be fixed to the LED assembly in a simple insertion operation without the need for any additional connection mechanisms, tools or assembly steps. While one embodiment of the snap-fit connection is shown numerous changes may be made. For example, the deformable members such as fingers 201 may be formed on the submount 129 and the fixed members may be formed on the reflector or each of the submount and reflector may include at least one of the deformable fingers and the fixed members. Moreover, both engagement members may be deformable. The engagement members may also be formed other than on the submount. For example, the engagement members may be formed on the housing, the enclosure, the heat sink or other lamp structure. Further, rather than using a snap-fit connection, the reflector 200 may be fixed to the lamp using other connection mechanisms such as adhesive, welding, separate fasteners, friction fit or the like.

With respect to the features described above with various example embodiments of a lamp, the features can be combined in various ways. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array. Any aspect or features of any of the embodiments described herein can be used with any feature or aspect of any other embodiments described herein or integrated together or implemented separately in single or multiple components.

In some embodiments a wireless module 300 may be provided in the bulb for receiving, and/or transmitting, a radio signal or other wireless signal between the lamp and a control system and/or between lamps. The wireless module may convert the radio wave to an electronic signal that may be delivered to the lamp electronics 110 for controlling operation of the lamp. The wireless module may be mounted on the board 80 and be in communication with the lamp electronics. The wireless module 300 may also be used to transmit a signal from the lamp. The wireless module may be positioned inside of the enclosure 112 or in the base 102. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety.

In some embodiments color control is used and RF control circuitry for controlling color may also be used in some embodiments. The lamp electronics may include light control circuitry that controls color temperature of any of the embodiments disclosed herein in accordance with user input such as disclosed in U.S. patent application Ser. No. 14/292,286, filed May 30, 2014, entitled "Lighting Fixture Providing Variable CCT" by Pope et al. which is incorporated by reference herein in its entirety.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED lamp comprising:

an optically transmissive enclosure and a base connected to the enclosure defining a longitudinal axis extending from the base to the enclosure;

a plurality of LEDs operable to emit light when energized through an electrical path from the base, the LEDs arranged in a plane;

a single reflector disposed in the enclosure extending above the plane, the reflector having an enclosed wall shape, at least one first LED of the plurality of LEDs being mounted inside of the reflector and a least one second LED of the plurality of LEDs being mounted outside of the reflector, the reflector comprising a reflective outer surface having a proximal end and a free distal end spaced from the enclosure where the reflective outer surface is disposed at a constant angle relative to the longitudinal axis between the proximal end and the distal end, the reflector being positioned relative to the at least one second LED such that the reflector reflects approximately 10% or less of the total lumen output by the at least one second LED whereby an omnidirectional luminous intensity distribution is generated.

2. The lamp of claim 1 wherein the reflector is a diffuse reflector.

3. The lamp of claim 1 wherein the reflector is made of molded plastic.

4. The lamp of claim 1 wherein the reflector comprises an annular shaped ring.

5. The lamp of claim 1 wherein the at least one first LED comprises a plurality of first LEDs and the at least one second LED comprises a plurality of second LEDs.

6. The lamp of claim 1 wherein the reflective outer surface diverges away from the longitudinal axis as it extends away from the base.

7. The lamp of claim 1 wherein the at least one second LED comprises a plurality of second LEDs arranged in a plane and the reflective outer surface has a proximal end and a free distal end where the reflective outer surface is disposed at an angle of less than 90 degrees relative to the plane of the LEDs between the proximal end and the distal end.

8. The lamp of claim 1 wherein the at least one second LED comprises a plurality of second LEDs arranged in a plane and the reflector comprises a reflective outer surface where the reflective outer surface is disposed at an angle of between approximately 83 and 89 degrees relative to the plane.

9. The lamp of claim 1 wherein the reflective outer surface is disposed at an angle of approximately 4 degrees relative to normal from the at least one second LED.

10. The lamp of claim 1 wherein in cross-section the reflective outer surface is a substantially straight line between the proximal end and the distal end.

11. The lamp of claim 1 wherein the reflective outer surface has a height of approximately 7 mm.

12. The lamp of claim 1 wherein the reflective outer surface has a height of less than approximately 10 mm.

13. The lamp of claim 1 wherein the reflective outer surface has a height in the range of approximately 5 to 15 mm.

14. The lamp of claim 1 wherein the reflective outer surface is disposed at an angle relative to the longitudinal axis where the angle is in the range of approximately 1 and 7°.

15. The lamp of claim 1 wherein the reflective outer surface is a smooth curve in a transverse plane.

16. The lamp of claim 1 wherein the reflector is positioned relative to the at least one second LED such that the reflector does not reflect the peak light emitted by the at least one second LED.

17. The lamp of claim 4 wherein a center of the reflector is on the longitudinal axis.

18. The lamp of claim 10 wherein the distal end of the reflective outer surface terminates at a free corner such that the reflective outer surface does not include any structure that extends away from the reflective outer surface.

19. A LED lamp comprising:

an optically transmissive enclosure;

a base connected to the enclosure;

a plurality of LEDs operable to emit light when energized through an electrical path from the base;

a single reflector disposed in the enclosure, the reflector having a completely enclosed annular or oval shape, at least one first LED of the plurality of LEDs being mounted inside of the reflector and a plurality of second LEDs being mounted outside of the reflector, the plurality of second LEDs arranged in a plane and the reflector comprising a reflective outer surface having a proximal end and a free distal end where the reflective outer surface is disposed at an angle relative to the plane between the proximal end and the distal end in a range of between approximately 83 and 89 degrees, the reflective outer surface having a height of less than approximately 10 mm positioned such that the reflective outer surface reflects approximately 10% or less of the total lumen output by the at least one second LED and does not reflect peak intensity light emitted by the plurality of second LEDs.

20. A LED lamp comprising:

an optically transmissive enclosure and a base connected to the enclosure defining a longitudinal axis extending from the base to the enclosure;

a plurality of LEDs operable to emit light when energized through an electrical path from the base;

a single reflector disposed in the enclosure, the reflector having an enclosed wall shape, at least one first LED of the plurality of LEDs being mounted inside of the reflector and a least one second LED of the plurality of LEDs being mounted outside of the reflector, the reflector being positioned relative to the at least one second LED such that the reflector reflects approximately 10% or less of the total lumen output by the at least one second LED whereby an omnidirectional luminous intensity distribution is generated.

21. The lamp of claim 20 wherein the reflector comprises a center section having a first end and a second end and a first end section and a second end section where the first end section extends from the first end of the center section and the second end section extending from the second end of the center section, a first one of the at least one first LED being positioned inside of the first end section and a second one of the at least one first LED being positioned inside of the second end section.

* * * * *